US012623829B2

(12) United States Patent
Kagimoto et al.

(10) Patent No.: US 12,623,829 B2
(45) Date of Patent: May 12, 2026

(54) VACUUM HEAT INSULATING CONTAINER

(71) Applicant: Panasonic Intellectual Property Management Co., Ltd., Osaka (JP)

(72) Inventors: Masahiro Kagimoto, Shiga (JP); Hideji Kawarazaki, Osaka (JP); Shinya Kojima, Kyoto (JP); Masafumi Okawa, Osaka (JP); Toshiaki Hirano, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 118 days.

(21) Appl. No.: 18/248,187

(22) PCT Filed: Oct. 25, 2021

(86) PCT No.: PCT/JP2021/039192

§ 371 (c)(1),
(2) Date: Apr. 6, 2023

(87) PCT Pub. No.: WO2022/201611

PCT Pub. Date: Sep. 29, 2022

(65) Prior Publication Data

US 2023/0406600 A1 Dec. 21, 2023

(30) Foreign Application Priority Data

Mar. 26, 2021 (JP) ..... 2021-052738

(51) Int. Cl.
*B65D 81/38* (2006.01)
*B65D 43/00* (2006.01)
(Continued)

(52) U.S. Cl.
CPC ..... *B65D 81/3818* (2013.01); *B65D 43/00* (2013.01); *B65D 51/24* (2013.01);
(Continued)

(58) Field of Classification Search
CPC ..... B65D 81/3818; B65D 51/24; B65D 65/38
See application file for complete search history.

(56) References Cited

U.S. PATENT DOCUMENTS

2004/0074936 A1* 4/2004 McDonald ..... A45C 11/20 206/541
2013/0306655 A1* 11/2013 Takushima ..... B65D 81/3818 220/592.27

(Continued)

FOREIGN PATENT DOCUMENTS

EP 3693649 8/2020
JP 2007-126188 5/2007

(Continued)

OTHER PUBLICATIONS

WO-2012017903-A1 English Translation.*

(Continued)

*Primary Examiner* — Jeffrey R Allen
(74) *Attorney, Agent, or Firm* — HSML P.C.

(57) ABSTRACT

A vacuum heat insulating container that can be easily subjected to inspection work is provided. A vacuum heat insulating container (1) includes: a container main body (100) including an opening (40*a*) and an accommodating space (40*b*); and a lid body (101). The container main body (100) includes a heat insulating container body (40) including: a first outer covering member (41) which is a molded body made of a nonmetal material and has a gas barrier property and a double wall structure; a first core member (42); and a pressure sensor (43). The lid body (101) includes: a heat insulating lid body (50) including a second outer covering member (51) having a sack shape formed by a flexible film which includes a metal layer and has a gas barrier property and a second core member (52); and a window (61) by which a surface of the second outer covering member (51) is visually confirmable.

4 Claims, 7 Drawing Sheets

(51) Int. Cl.

| | |
|---|---|
| ***B65D 51/24*** | (2006.01) |
| ***B65D 65/38*** | (2006.01) |
| ***B65D 81/26*** | (2006.01) |

(52) U.S. Cl.
CPC ..... *B65D 65/38* (2013.01); *B65D 81/266* (2013.01); *B65D 2543/00194* (2013.01); *B65D 2565/387* (2013.01)

(56) References Cited

U.S. PATENT DOCUMENTS

| | | | | |
|---|---|---|---|---|
| 2014/0169926 | A1* | 6/2014 | Henderson ..... | B65D 81/3834 414/800 |
| 2016/0046429 | A1* | 2/2016 | Bray ..... | B65D 81/3818 53/440 |
| 2020/0079575 | A1 | 3/2020 | Kitano et al. | |
| 2022/0348395 | A1 | 11/2022 | Kagimoto et al. | |

FOREIGN PATENT DOCUMENTS

| | | | | |
|---|---|---|---|---|
| JP | 2007-283989 | | 11/2007 | |
| JP | 2008-30790 | A | 2/2008 | |
| JP | 2015-168465 | | 9/2015 | |
| JP | 2019-065995 | | 4/2019 | |
| JP | 2020-037445 | | 3/2020 | |
| JP | 2020-083428 | | 6/2020 | |
| JP | 2020-519537 | | 7/2020 | |
| WO | WO-2012017903 | A1 * | 2/2012 | ..... F16L 59/065 |
| WO | 2018/213448 | | 11/2018 | |
| WO | 2020/255887 | A1 | 12/2020 | |

OTHER PUBLICATIONS

English Translation.*
International Search Report of PCT/JP2021/039192, Nov. 22, 2021, 2 pages.
Extended European Search Report, European Patent Application No. 21933209.5, Sep. 12, 2024 (9 pages).

* cited by examiner

VACUUM HEAT INSULATING CONTAINER

TECHNICAL FIELD

The present disclosure relates to a vacuum heat insulating container that maintains an internal temperature for a long period of time.

BACKGROUND ART

A heat insulating container disclosed in PTL 1 has been known as a container that keeps contents cold. The heat insulating container of PTL 1 includes: a container which has a rectangular solid shape and includes an opening; and an upper lid that opens or closes the opening of the container. Moreover, each of the container and the upper lid has a double wall structure. A vacuum insulator having a flat plate shape is accommodated in each of six inter-wall spaces that are inter-wall spaces of the respective surfaces of the container and an inter-wall space of the upper lid.

CITATION LIST

Patent Literature

PTL 1: Japanese Laid-Open Patent Application Publication No. 2007-126188

SUMMARY OF INVENTION

Technical Problem

Gas may intrude into the vacuum insulator through an outer covering member or through an adhesive interface between outer covering members. Therefore, from a long-term viewpoint, the thermal insulation performance of the vacuum insulator deteriorates over time. Moreover, the thermal insulation performance of the vacuum insulator may deteriorate when the outer covering member wears by external force applied during use. Therefore, the thermal insulation performance of the vacuum insulator needs to be inspected timely especially when the vacuum insulator is assumed to be used in a case where severe temperature management is required, such as a case of transportation of medicine.

However, in the heat insulating container of PTL 1, six vacuum insulators that are independent from each other are included at six places in the container and the upper lid as described above. Therefore, these six vacuum insulators need to be individually inspected. Thus, time and labor are required for inspection work.

The present disclosure was made to solve the above problems, and an object of the present disclosure is to provide a vacuum heat insulating container that can be easily subjected to inspection work.

Solution to Problem

A vacuum heat insulating container according to a first aspect of the present disclosure includes: a container main body including an opening and an accommodating space communicating with the opening; and a lid body covering the opening of the container main body. The container main body includes a heat insulating container body including: a first outer covering member that is a molded body made of a nonmetal material and has a gas barrier property and a double wall structure; a first core member accommodated in an inter-wall space of the first outer covering member; and a pressure sensor which is accommodated in the inter-wall space of the first outer covering member and is communicable with an outside, the inter-wall space of the first outer covering member being reduced in pressure. The lid body includes: a heat insulating lid body including a second outer covering member having a sack shape formed by a flexible film which includes a metal layer and has a gas barrier property, and a second core member accommodated in the second outer covering member, an inside of the second outer covering member being reduced in pressure; and a visible portion by which a surface of the second outer covering member of the heat insulating lid body is visually confirmable.

According to this configuration, the heat insulating container body included in the container main body has the double wall structure formed by the molded body. Therefore, even the heat insulating container body having, for example, a rectangular solid shape can be formed such that the inter-wall spaces communicate with each other. Moreover, since the first outer covering member constituting the heat insulating container body is made of nonmetal, a radio wave emitted from the pressure sensor accommodated in the first outer covering member can be transmitted to an outside. Therefore, the thermal insulation performance of the heat insulating container body can be measured by, for example, a single pressure sensor. Moreover, the heat insulating lid body included in the lid body includes the second outer covering member which is formed by a flexible film including a metal layer. Therefore, when gas intrudes into the heat insulating lid body, and this deteriorates the thermal insulation performance, the surface of the second outer covering member deforms, i.e., for example, the second outer covering member swells. Then, the deformation of the second outer covering member can be visually confirmed through the visible portion. As above, in the vacuum heat insulating container according to the present disclosure, the heat insulating container body can be inspected by, for example, a single operation performed by the pressure sensor, and the heat insulating lid body can be visually inspected timely. Therefore, inspection work is easy.

The vacuum heat insulating container according to a second aspect of the present disclosure may be configured such that in the first aspect, the lid body includes a lid case accommodating the heat insulating lid body, and the lid case includes a window as the visible portion.

According to this configuration, while protecting the heat insulating lid body by the lid case, the presence or absence of the deformation of the second outer covering member of the heat insulating lid body can be visually confirmed through the window.

The vacuum heat insulating container according to a third aspect of the present disclosure may be configured such that: in the first or second aspect, the vacuum heat insulating container includes a first gas adsorbent located in the inter-wall space of the first outer covering member of the heat insulating container body and a second gas adsorbent located in the second outer covering member of the heat insulating lid body; and a life of gas adsorption ability of the second gas adsorbent is longer than a life of gas adsorption ability of the first gas adsorbent.

According to this configuration, the life of the thermal insulation performance of the heat insulating lid body is longer than the life of the thermal insulation performance of the heat insulating container body. Therefore, when it is confirmed by the inspection that the thermal insulation performance of the heat insulating container body is being maintained, it can be basically determined that the thermal insulation performance of the heat insulating lid body is also being maintained. On this account, the frequency of visual inspection of the heat insulating lid body can be reduced. Thus, the inspection work can be made easier.

The vacuum heat insulating container according to a fourth aspect of the present disclosure may be configured such that: in any one of the first to third aspects, the container main body further includes a protective member covering an outer surface of the heat insulating container body; and at a portion of the protective member which corresponds to the pressure sensor located at the heat insulating container body, a recess that is recessed from the other portion of the protective member is formed.

According to this configuration, the heat insulating container body can be protected by the protective member from external force applied during use. In addition, when inspecting the thermal insulation performance, a receiver for inspection is pushed into the recess of the protective member from an outside, and therefore, a radio wave from the pressure sensor can be received. On this account, even when communication can be performed only within an extremely short distance, the radio wave from the pressure sensor can be surely received, and therefore, accurate inspection can be performed.

Advantageous Effects of Invention

The present disclosure can provide a vacuum heat insulating container that can be easily subjected to inspection work.

DESCRIPTION OF EMBODIMENTS

Hereinafter, an embodiment of the present disclosure will be specifically described with reference to the drawings. In the following description and the drawings, the same reference signs are used for the same or corresponding components, and the repetition of the same explanation is avoided.

Figure 1:
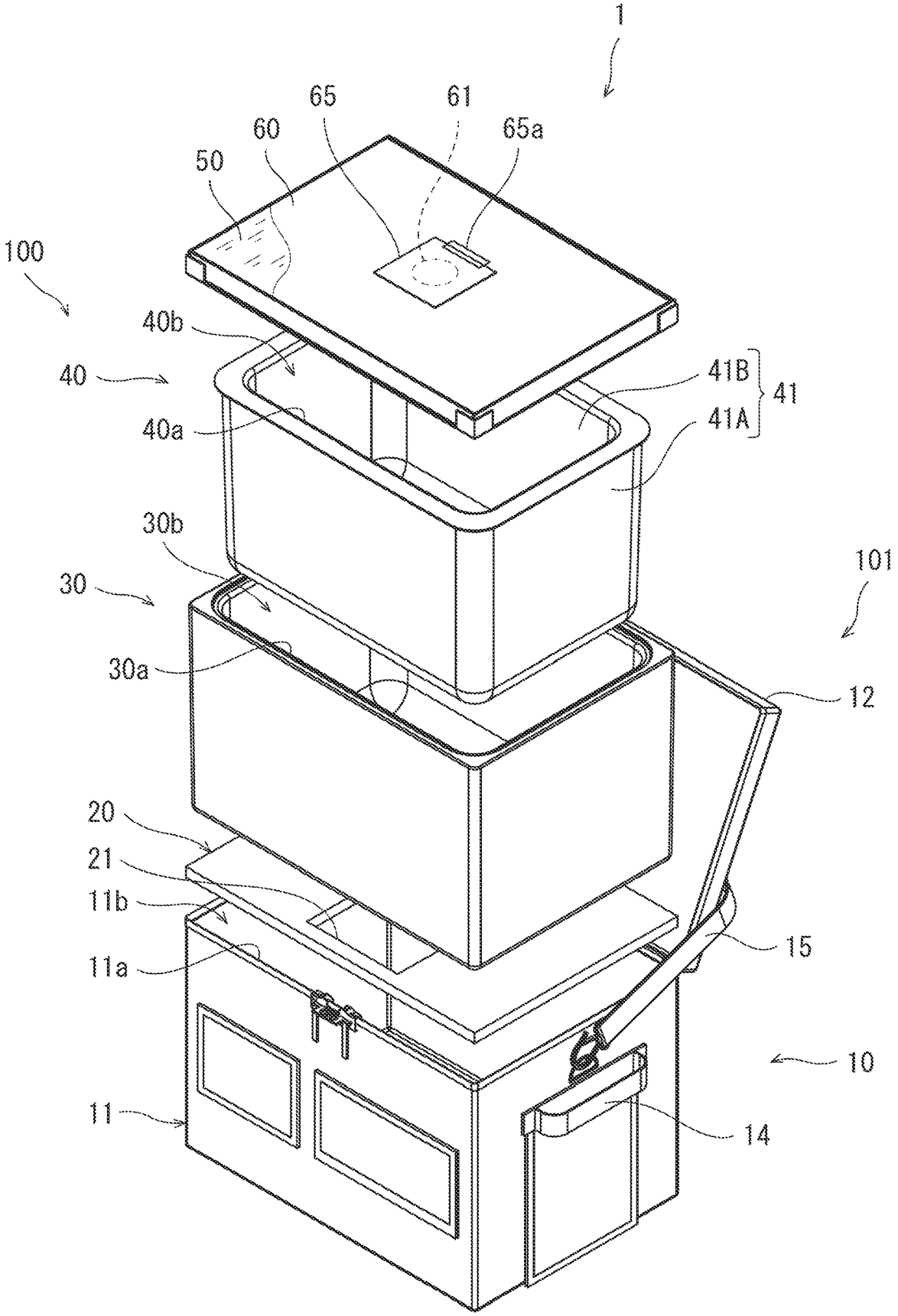
FIG. 1 is an assembly diagram showing an appearance configuration of a vacuum heat insulating container according to an embodiment of the present disclosure when viewed from an oblique direction.
Figure 2:
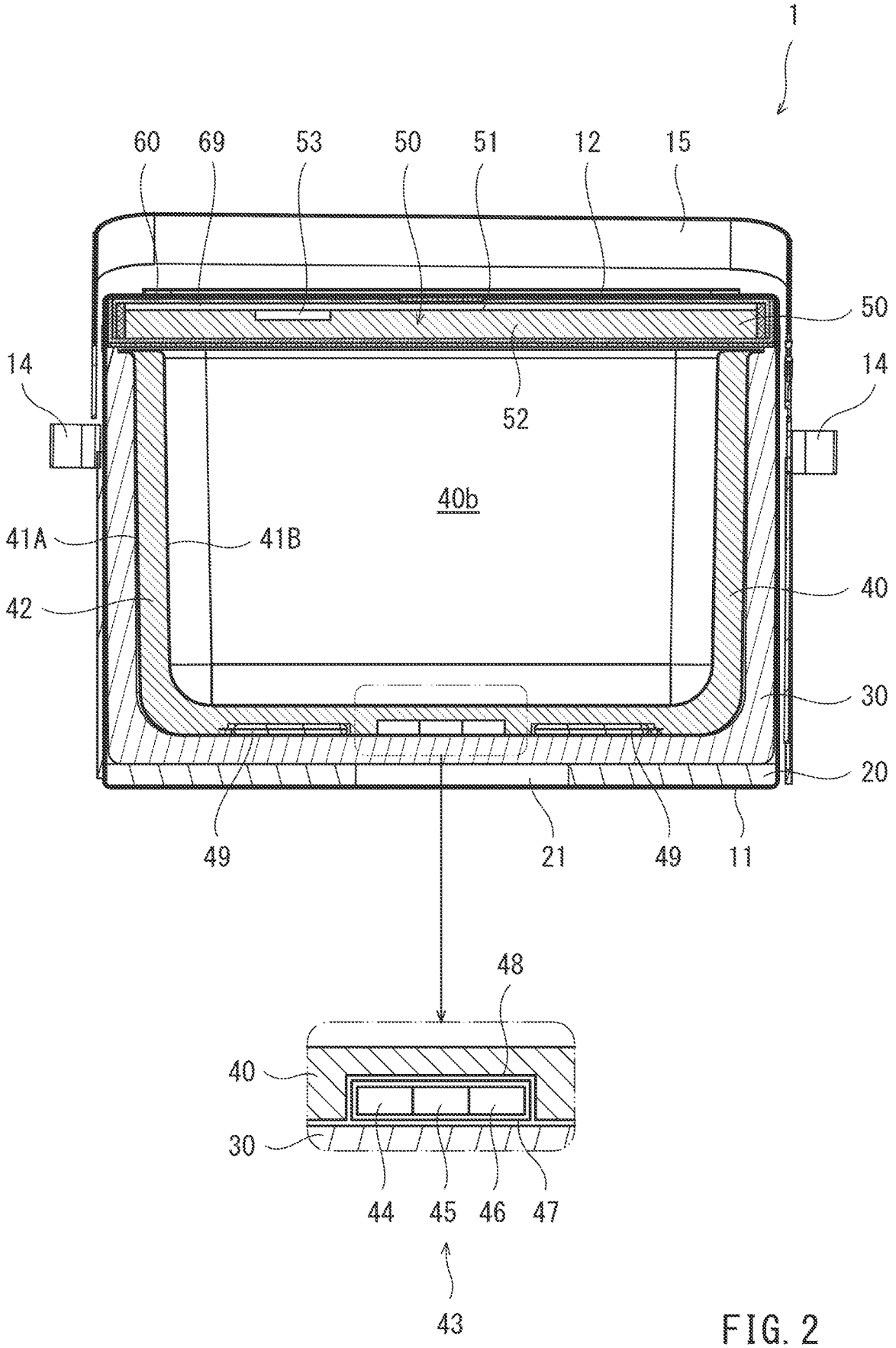
FIG. 2 is a sectional view of the vacuum heat insulating container.

A vacuum heat insulating container 1 shown in FIGS. 1 and 2 is a heat retaining container used to transport or store articles, such as medicines, samples, or foods. The vacuum heat insulating container 1 includes an exterior bag 10 (including an exterior sack 11 and an exterior lid 12), a protection bottom plate 20, a protection box 30, a heat insulating container body 40, and a heat insulating lid body 50. The exterior sack 11, the protection bottom plate 20, the protection box 30, and the heat insulating container body 40 constitute a container main body 100 according to the present disclosure, and the exterior lid 12 and the heat insulating lid body 50 constitute a lid body 101 according to the present disclosure. Hereinafter, these members will be described in detail.

Exterior Bag

The exterior bag 10 includes the exterior sack 11 and the exterior lid 12. The exterior sack 11 is formed by using flexible cloth made of chemical fibers, such as nylon or polyester. The exterior sack 11 has a sack shape formed in a laterally long rectangular solid shape whose one surface (upper surface) is an opening 11*a*. The exterior sack 11 includes an internal space 11*b*. Moreover, handles 14 which can be held by human hands are respectively attached to left and right side surfaces of the exterior sack 11, and a belt 15 extends between the left and right side surfaces.

The exterior lid 12 has a rectangular plate shape whose contour is substantially the same as the contour of the opening 13 of the exterior sack 11. One side portion of the exterior lid 12 is in connection with a rear-upper side portion of the exterior sack 11. Then, the exterior lid 12 can close the opening 11*a* of the exterior sack 11 by being tilted forward. Moreover, the exterior lid 12 is formed in a sack shape by using cloth made of the same chemical fibers as the exterior sack 11. A fastener that is openable and closable is provided at one side portion of the exterior lid 12 or a plurality of adjacent side portions of the exterior lid 12. The heat insulating lid body 50 is accommodated in the exterior lid 12 through the fastener (the heat insulating lid body 50 will be described later).

In the following description, a side where the exterior lid 12 is in connection with the exterior sack 11 as described above is referred to as a "rear side," and its opposite side is referred to as a "front side." Moreover, a "left-right direction" is defined based on when viewed from front. A side where the opening 13 of the exterior sack 11 is located is referred to as an "upper side," and its opposite side that is a side where the bottom of the exterior sack 11 is located is referred to as a "lower side."

Protection Bottom Plate and Protection Box

The protection bottom plate 20 is a protective member made of a foaming material, such as polyethylene foam. The protection bottom plate 20 has a rectangular flat plate shape. In plan view, the shape of the protection bottom plate 20 is substantially the same as the shape of an inner bottom surface of the exterior sack 11. A rectangular opening 21 that penetrates the protection bottom plate 20 is formed at a predetermined position of the protection bottom plate 20. In the present embodiment, the opening 21 is formed at a position that is a middle position in the left-right direction and is a position closer to the front side in the front-rear direction.

The protection box 30 is a protective member made of the same foaming material as the protection bottom plate 20. The protection box 30 is formed in a rectangular solid shape whose upper surface includes an opening 30*a* that communicates with an internal space 30*b*. Moreover, in plan view, the shape of the protection box 30 is substantially the same as the inner bottom surface of the exterior sack 11.

The protection bottom plate 20 and the protection box 30 constitute a protective member. When assembling the vacuum heat insulating container 1, first, the opening 13 of the exterior sack 11 is opened. Next, the protection bottom plate 20 is placed so as to be opposed to the bottom surface of the exterior sack 11. Then, the protection box 30 is accommodated in the exterior sack 11 so as to be placed on the protection bottom plate 20. A height of a combination of the protection bottom plate 20 and the protection box 30 stacked in the upper-lower direction is substantially equal to a height of the exterior sack 11.

Heat-Insulating Container Body

The heat insulating container body 40 includes a first outer covering member 41, a first core member 42, and a pressure sensor 43. The first outer covering member 41 is a molded body made of a nonmetal material and has a gas barrier property and a double wall structure. The first core member 42 is accommodated in an inter-wall space of the first outer covering member 41. The pressure sensor 43 is accommodated in the inter-wall space of the first outer covering member 41 and is communicable with an outside. Then, the pressure of the inter-wall space of the first outer covering member 41 is reduced to predetermined pressure, and the inside of the inter-wall space of the first outer covering member 41 is sealed.

More specifically, the first outer covering member 41 is a member that maintains the degree of vacuum of the heat insulating container body 40. The first outer covering member 41 is made of a nonmetal material, such as synthetic resin, by die forming and can maintain a certain shape. As a result, as shown in FIG. 1, the entire heat insulating container body 40 has a rectangular solid container shape and includes an opening 40*a* that communicates with an internal space 40*b*. Moreover, the first outer covering member 41 has a double wall structure in which an outer body 41A having a large volume and an inner body 41B having a small volume are combined with each other. The first outer covering member 41 can adopt, for example, a laminated structure including a thermally weldable thermoplastic resin layer, an air barrier layer made of ethylene-vinyl alcohol copolymer, polyvinyl alcohol polymer, or the like, and a steam barrier layer made of polypropylene or the like.

The first core member 42 is made of a material having low thermal conductivity. The first core member 42 serves as a frame of the heat insulating container body 40 and forms a heat insulating space that is the inter-wall space of the first outer covering member 41. For example, the first core member 42 is formed by a porous body. Specifically, the first core member 42 can be configured by using one or a plurality of: an open-cell body such as open-cell urethane foam; a glass fiber assembly; and an inorganic fine particle assembly.

The pressure sensor 43 includes a pressure detecting portion 44, a transmitting portion 45, and an electric power supply portion 46. The pressure detecting portion 44 detects pressure (atmospheric pressure) of an internal space of the first outer covering member 41. The transmitting portion 45 wirelessly transmits information, detected by this pressure detecting element, to an outside. The electric power supply portion 46 supplies electric power to the pressure detecting portion 44 and the transmitting portion 45. Moreover, the pressure sensor 43 includes a sensor case 47 including a plurality of through holes through which an inside and outside of the sensor case 47 communicate with each other. The pressure detecting portion 44, the transmitting portion 45, and the electric power supply portion 46 are accommodated in the sensor case 47.

Known as the pressure detecting portion 44 is, for example, a detecting portion that includes a heater and a thermocouple and measures the atmospheric pressure (degree of vacuum) by measuring peripheral thermal conductivity characteristics from a temperature detected by the thermocouple when the heater is heated. However, the configuration of the pressure detecting portion 44 is not limited to this, and a micro electro-mechanical system (MEMS) of a piezoelectric type, an electrostatic capacitance type, a vibration type, or the like may be adopted.

The transmitting portion 45 is electrically connected to the pressure detecting portion 44 and wirelessly transmits information regarding the pressure detected by the pressure detecting portion 44 to an outside. To do this, the transmitting portion 45 includes a communication control IC, a memory, an antenna, and the like. For example, the transmitting portion 45 is a near field communication device using a frequency of 13.56 MHz band and transmits information through NFC (Near Field Communication).

The electric power supply portion 46 are electrically connected to the pressure detecting portion 44 and the transmitting portion 45 and supplies electric power to the pressure detecting portion 44 and the transmitting portion 45. For example, the electric power supply portion 46 includes an electric power supply control IC and an electric power receiving portion for magnetic resonance wireless electric power supply. The electric power receiving portion includes a secondary coil (electric power receiving coil) that receives electric power in a non-contact manner from a primary coil (electric power transmitting coil) located outside the first outer covering member 41. The electric power receiving coil receives electric power transmitted from the electric power transmitting coil, and the electric power supply control IC supplies this electric power to the pressure detecting portion 44 and the transmitting portion 45.

The sensor case 47 that accommodates the pressure detecting portion 44, the transmitting portion 45, and the electric power supply portion 46 is made of a nonmetal material, such as resin, and has, for example, a flat plate shape that is flat in the upper-lower direction. The pressure sensor 43 is provided at a lower portion of the heat insulating container body 40. More specifically, a lower surface of the first core member 42 in the inter-wall space of a predetermined portion of a bottom portion of the heat insulating container body 40 is recessed upward, and a sensor accommodating space 48 is formed between the outer body 41A of the first outer covering member 41 and the lower surface of the first core member 42. The pressure sensor 43 is arranged in the sensor accommodating space 48.

The heat insulating container body 40 is accommodated in an internal space 32 of the protection box 30. Herein, in the present embodiment, the position where the sensor accommodating space 48 is formed is a position that is a middle position of the bottom portion of the heat insulating container body 40 in the left-right direction and is a position closer to the front side in the front-rear direction. Therefore, with the heat insulating container body 40 accommodated in the protection box 30, the position of the opening 21 of the protection bottom plate 20 and the position of the pressure sensor 43 substantially coincide with each other in plan view. For example, in plan view, the entire pressure sensor 43 is located in the opening 21.

Moreover, as described above, the protective member covering an outer surface of the heat insulating container body 40 is constituted by the protection bottom plate 20 and the protection box 30, and the opening 21 is formed on the protection bottom plate 20. Therefore, at a portion of the protective member (the protection bottom plate 20 and the protection box 30) which corresponds to the pressure sensor 43 provided at the heat insulating container body 40, a recess that is recessed from the other portion of the protective member is formed. More specifically, this recess is formed by the opening 21 of the protection bottom plate 20.

Moreover, the heat insulating container body 40 according to the present embodiment includes first gas adsorbents 49. As shown in FIG. 2, each of the first gas adsorbents 49 has a flat shape and is located between the first core member 42 and the outer body 41A in the heat insulating space inside the first outer covering member 41. Moreover, in the present embodiment, the first gas adsorbents 49 are arranged at two positions, i.e., left and right positions so as to sandwich the pressure sensor 43.

Heat-Insulating Lid Body

The heat insulating lid body 50 that constitutes the lid body 101 has a flat plate shape that is rectangular in plan view. The heat insulating lid body 50 includes a second outer covering member 51 and a second core member 52. The second outer covering member 51 has a sack shape formed by a flexible film which includes a metal layer and has a gas barrier property. The second core member 52 is accommodated in the second outer covering member 51. Then, the inside of the second outer covering member 51 is reduced in pressure to predetermined pressure and is sealed. Moreover, the lid body 101 includes a lid case 60 that accommodates the heat insulating lid body 50. FIG. 1 shows the heat insulating lid body 50 in the lid case 60 by cutting out a part of the lid case 60. The lid case 60 includes a window 61 that is a visible portion through which the surface of the second outer covering member 51 can be visually confirmed. The heat insulating lid body 50 is accommodated in the lid case 60 and is further accommodated in the exterior lid 12.

More specifically, the second outer covering member 51 is a member that maintains the degree of vacuum of the heat insulating lid body 50 and has a multilayer structure. For example, an innermost layer of the second outer covering member 51 is a low-density polyethylene film as a thermal welding layer, and an outermost layer of the second outer covering member 51 is a nylon film as a surface protection layer. Moreover, as a gas barrier layer that suppresses penetration of gas and moisture, the second outer covering member 51 includes, for example, a PET film which is located between the thermal welding layer and the surface protection layer and on which aluminum is deposited. However, the configuration of the second outer covering member 51 is not limited to this, and the second outer covering member 51 may adopt another configuration that can maintain the degree of vacuum of the heat insulating lid body 50.

The second core member 52 is made of a material having low heat conductivity. When the inside of the second outer covering member 51 is reduced in pressure, the second core member 52 serves as a frame of the heat insulating lid body 50 and forms a heat insulating space inside the second outer covering member 51. For example, the second core member 52 can be configured by using one or a plurality of: an open-cell body such as open-cell urethane foam; a glass fiber assembly; and an inorganic fine particle assembly. The heat insulating lid body 50 is configured such that: the second core member 52 is accommodated in the second outer covering member 51 having a sack shape; and the inside of the second outer covering member 51 is reduced in pressure to have a predetermined degree of vacuum and is then sealed.

Moreover, the heat insulating lid body 50 according to the present embodiment includes a second gas adsorbent 53. As shown in FIG. 2, the second gas adsorbent 53 has a flat shape and is arranged in the heat insulating space inside the second outer covering member 51 so as to be sandwiched between the second core member 52 and the second outer covering member 51.

Figure 3A:
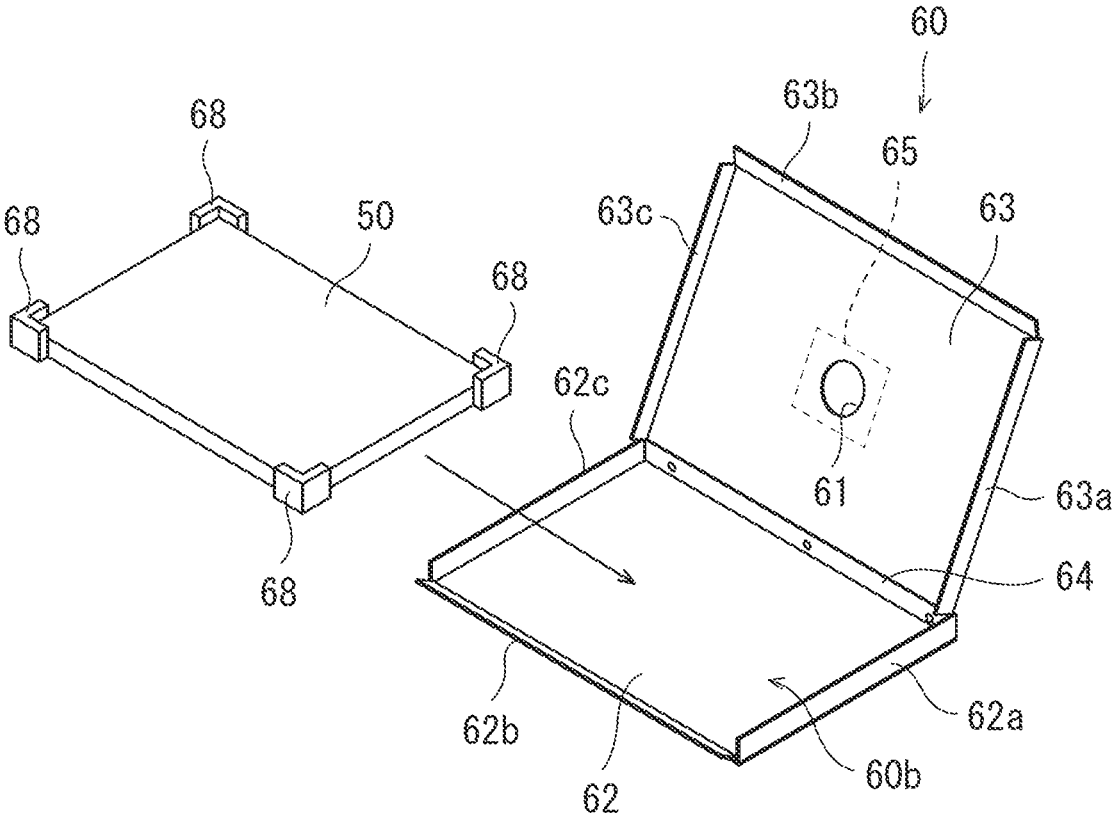
FIG. 3A is a perspective view of a lid case.

The heat insulating lid body 50 is accommodated in the lid case 60 including the window 61. As shown in FIG. 3A, the lid case 60 has a flat plate shape that is rectangular in plan view. The lid case 60 includes an internal space 60*b* that accommodates the heat insulating lid body 50. More specifically, the lid case 60 includes a rectangular lower plate 62 and a rectangular upper plate 63. The lower plate 62 and the upper plate 63 are connected to each other by an elongated band-shaped side plate 64 at one long-side portion of the upper plate 62 and one long-side portion of the lower plate 63 which correspond to each other. Moreover, elongated band-shaped side plates 62*a*, 62*b*, and 62*c* respectively extend from the other three side portions of the lower plate 62, and elongated plate-shaped side plates 63*a*, 63*b*, and 63*c* respectively extend from the other three side portions of the upper plate 63.

The lid case 60 opens or closes in such a manner that the lower plate 62 and the upper plate 63 contact each other or separate from each other by using the side plate 64 as a base point. Moreover, when the lower plate 62 and the upper plate 63 are closed, the side plates 62*a*, 62*b*, and 62*c* and the corresponding side plates 63*a*, 63*b*, and 63*c* overlap each other to form a double side wall. The lid case 60 constitutes a protective member that protects the heat insulating lid body 50 accommodated in the internal space 60*b*. Therefore, the lid case 60 is formed by a buffer member and can be formed by, for example, cutting and bending a polypropylene foam sheet. A height of the internal space 60*b* is set to be slightly (about several millimeters) larger than a height (thickness) of the heat insulating lid body 50.

The window 61 is formed at a middle of the upper plate 63 of the lid case 60. The window 61 has a circular shape having a predetermined diameter and is formed so as to penetrate the upper plate 63. The diameter of the window 61 can be selected from, for example, a range of 30 mm or more and 80 mm or less.

Figure 3B:
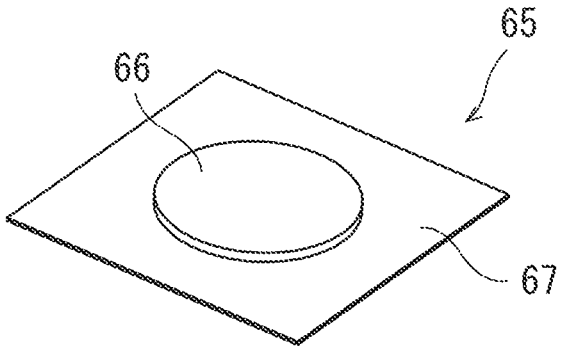
FIG. 3B is a perspective view of a window cover attached to the lid case.

A window cover 65 is provided at the window 61. As shown in FIG. 3B, the window cover 65 includes a cushion member 66 and a supporting plate 67. The cushion member 66 has a circular plate shape which is substantially the same in shape and dimension as the window 61. The thickness of the cushion member 66 is the same as that of the upper plate 63. The cushion member 66 is made of, for example, polyethylene resin. The supporting plate 67 has a rectangular sheet shape whose one side portion is longer than the diameter of the cushion member 66. The cushion member 66 is attached to a middle of the supporting plate 67 with a double-sided tape or the like.

With the cushion member 66 fitted in the window 61, one side portion of the supporting plate 67 of the window cover 65 is connected to a predetermined portion of an upper surface of the upper plate 63 of the lid case 60 with an adhesive tape 65*a*. Therefore, the window cover 65 can open or close by using the above one side portion as a base point. When the window cover 65 opens, the inside of the lid case 60 can be visually confirmed through the window 61.

The heat insulating lid body 50 is accommodated in the lid case 60. At this time, buffers 68 are provided at four corners of the rectangular heat insulating lid body 50. Each of the buffers 68 has an L shape in plan view. A height of the buffer 68 is larger than the height (thickness) of the heat insulating lid body 50 and is substantially the same as the height of the internal space 60*b* of the lid case 60. With the buffers 68 attached to four corners of the heat insulating lid body 50, the heat insulating lid body 50 is accommodated in the internal space 60*b* of the lid case 60. Therefore, a small gap 69 is formed between an inner surface of the lid case 60 and an outer surface of the heat insulating lid body 50 (in the present embodiment, above the heat insulating lid body 50, i.e., between an inner surface of the upper plate 63 of the lid case 60 and an upper surface of the heat insulating lid body 50).

Moreover, when the window cover 65 at the upper portion of the lid case 60 opens with the heat insulating lid body 50 accommodated in the internal space 60*b*, the second outer covering member 52 at the upper portion of the heat insulating lid body 50 can be visually confirmed through the window 61 and can be directly touched with human hands.

Actions and Effects

In the vacuum heat insulating container 1 described above, the heat insulating container body 40 included in the container main body 100 has the double wall structure formed by the molded body. Therefore, even the heat insulating container body having, for example, a rectangular solid shape can be formed such that the inter-wall spaces communicate with each other. Moreover, since the first outer covering member 41 constituting the heat insulating container body 40 is made of nonmetal, a radio wave emitted from the pressure sensor 43 accommodated in the first outer covering member 41 can be transmitted to an outside. Therefore, the thermal insulation performance of the heat insulating container body 40 can be measured by, for example, a single pressure sensor.

Figure 4A:
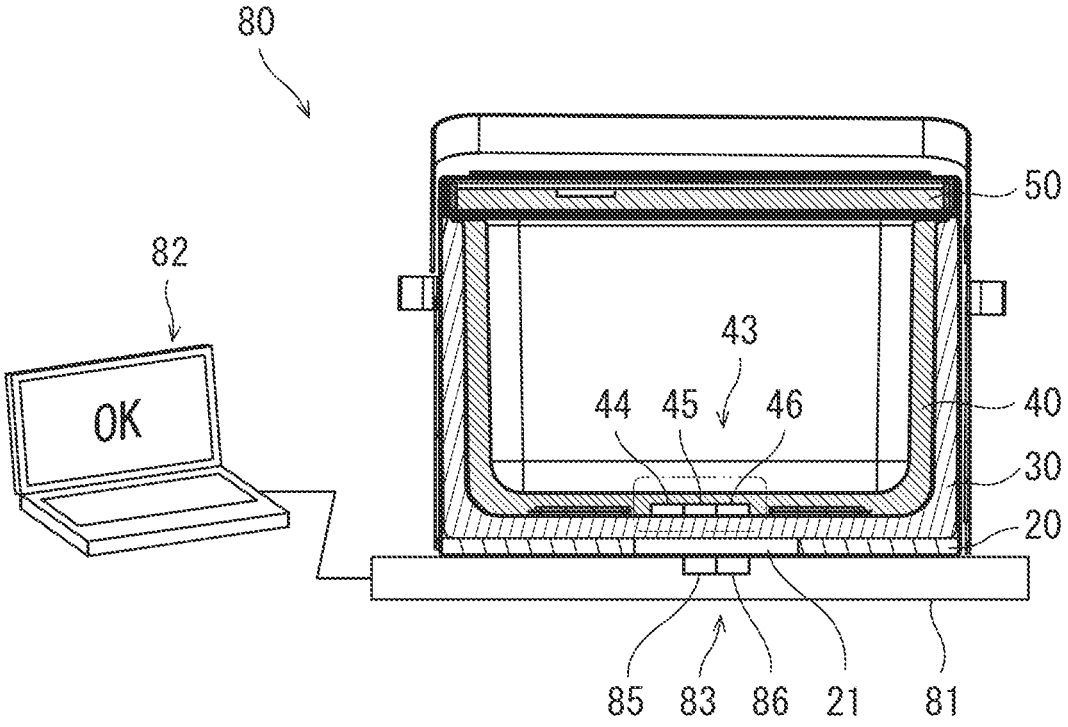
FIG. 4A is a schematic diagram showing an inspection system that inspects thermal insulation performance of a heat insulating container body.

FIG. 4A shows one example of an inspection system that inspects the thermal insulation performance of the heat insulating container body 40. As shown in FIG. 4A, a system 80 includes an inspection table 81 and a computer 82. An inspection unit 83 is provided at a predetermined position of the inspection table 81. The inspection unit 83 includes a receiving portion 85 and an electric power transmitting portion 86. The receiving portion 85 includes, for example, a communication control IC, a memory, an antenna, and the like and can communicate with the transmitting portion 45 included in the pressure sensor 43 of the heat insulating container body 40 through, for example, NFC. Moreover, the electric power transmitting portion 86 includes an electric power transmitting coil constituting a primary coil in the system 80 and generates a magnetic field by electric power supply from a power supply, not shown.

When inspecting the thermal insulation performance of the heat insulating container body 40 by using the inspection system, first, the vacuum heat insulating container 1 is placed at a predetermined position of the inspection table 81. The position at which the vacuum heat insulating container 1 is placed is such a position that power supply and communication can be performed between the pressure sensor 43 and the inspection unit 83, for example, such a position that the pressure sensor 43 and the inspection unit 83 are opposed to each other. A guide sign indicating the position at which the vacuum heat insulating container 1 is placed may be shown on an upper surface of the inspection table 81. Then, when the electric power transmitting portion 86 of the inspection table 81 is supplied with electric power to generate the magnetic field with the vacuum heat insulating container 1 placed on the inspection table 81, electromagnetic induction is generated at the secondary coil (electric power receiving coil) included in the electric power supply portion 46 of the heat insulating container body 40, and thus, the pressure sensor 43 is supplied with electric power. By the electric power supplied as above, the pressure sensor 43 detects the pressure by the pressure detecting portion 44 and transmits information regarding the detected pressure by the transmitting portion 45. The transmitted information is received by the receiving portion 85 of the inspection table 81 and is then supplied to the computer 82. The computer 82 determines based on the input information whether or not the thermal insulation performance of the heat insulating container body 40 is allowable. Then, the computer 82 outputs (for example, displays) the results.

Moreover, the heat insulating lid body 50 included in the lid body 101 includes the second outer covering member 51 which is formed by a flexible film including a metal layer. Therefore, when gas intrudes into the heat insulating lid body 50, and this deteriorates the thermal insulation performance, the surface of the second outer covering member 51 deforms, i.e., for example, the second outer covering member 51 swells. Then, the deformation of the second outer covering member 51 can be visually confirmed through the window 61 that is the visible portion.

Figure 4B:
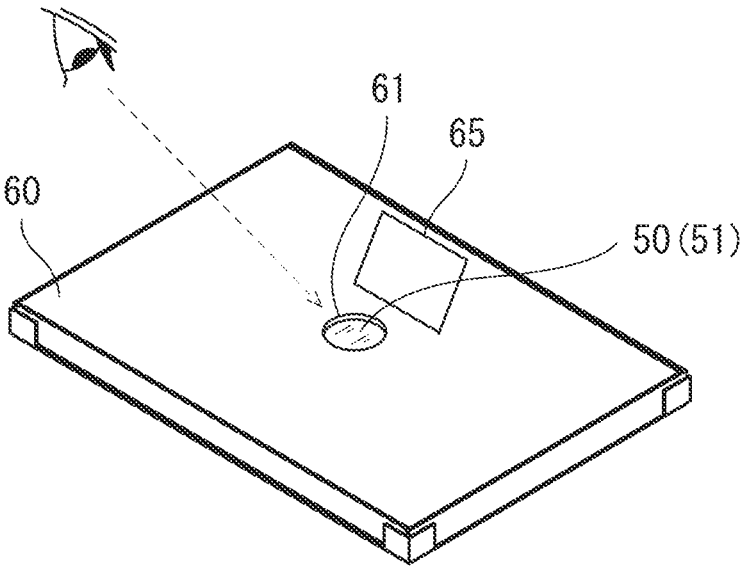
FIG. 4B is a schematic diagram showing that a heat insulating lid body is visually confirmed.

FIG. 4B specifically shows that the heat insulating lid body 50 is inspected by visual confirmation. First, when inspecting the heat insulating lid body 50, the lid case 60 including the heat insulating lid body 50 is taken out from the exterior lid 12 of the lid body 101. By opening the window cover 65 located at the upper portion of the lid case 60 that has been taken out, the heat insulating lid body 50 (to be precise, the second outer covering member 51) inside the lid case 60 can be visually confirmed through the window 61. For example, if the second outer covering member 51 breaks, and air flows into the heat insulating lid body 50, the heat insulating lid body 50 deforms, i.e., for example, expands. Therefore, such state can be visually confirmed through the window 61. Especially, in the lid body 101 according to the present embodiment, since the gap 69 exists above the heat insulating lid body 50 in the lid case 60, the deformation of the second outer covering member 51 is not inhibited, and such deformation can be visually confirmed easily.

As above, in the vacuum heat insulating container 1 according to the present disclosure, the heat insulating container body 40 can be inspected by, for example, a single operation performed by the pressure sensor 43, and the heat insulating lid body 50 can be visually inspected timely. Therefore, inspection work is easy.

Moreover, in the vacuum heat insulating container 1, the heat insulating container body 40 is covered with the protective member, and the protection bottom plate 20 included in the protective member includes the opening 21. Then, at a portion of the protective member which corresponds to the pressure sensor 43 provided at the heat insulating container body 40, a recess that is recessed from the other portion of the protective member is formed by the opening 21. Furthermore, the exterior sack 11 covering the opening 21 is formed by using flexible cloth made of chemical fibers.

With this, the heat insulating container body 40 can be protected from external force. In addition, when inspecting the thermal insulation performance, a receiver for inspection is placed on the cloth of the exterior sack 11 and pushed into the recess of the protective member from an outside, and therefore, a radio wave from the pressure sensor can be received. On this account, even when communication with the pressure sensor 43 can be performed only within an extremely short distance, the radio wave from the pressure sensor 43 can be surely received, and therefore, accurate inspection can be performed.

Moreover, in the vacuum heat insulating container 1 according to the present embodiment, the first outer covering member 41 included in the heat insulating container body 40 of the container main body 100 is the molded body made of a nonmetal material, and therefore, the radio wave can be transmitted through the first outer covering member 41. On this account, communication between the accommodating space 40*b* of the heat insulating container body 40 and the outside of the vacuum heat insulating container 1 can be performed. For example, a temperature sensor with a wireless communication function is put in the accommodating space 40*b*, and the radio wave from the temperature sensor is received at the outside of the vacuum heat insulating container 1. Thus, with the lid body 101 closed, the temperature of the accommodating space 40*b* can be checked.

Other Configurations

As described above, the first gas adsorbent 49 is provided in the inter-wall space of the first outer covering member 41 of the heat insulating container body 40, and the second gas adsorbent 53 is provided at the inside of the second outer covering member 51 of the heat insulating lid body 50. In this case, the life of gas adsorption ability of the second gas adsorbent 53 may be set to be longer than the life of gas adsorption ability of the first gas adsorbent 49.

According to this configuration, the life of the thermal insulation performance of the heat insulating lid body 50 is longer than the life of the thermal insulation performance of the heat insulating container body 40. Therefore, when it is confirmed by the inspection that the thermal insulation performance of the heat insulating container body 40 is being maintained, it can be basically determined that the thermal insulation performance of the heat insulating lid body 50 is also being maintained. On this account, the frequency of visual inspection of the heat insulating lid body 50 can be reduced. Thus, the inspection work can be made easier.

The life (days) of the adsorption ability of the first gas adsorbent 49 and the life (days) of the adsorption ability of the second gas adsorbent 53 can be set as below. To be specific, the amount of gas adsorbed by 1 gram of the adsorbent to be used is referred to as adsorption ability [cc/g], the amount of adsorbent to be used is referred to as an adsorbent amount [g], the initial amount of gas remaining in the heat insulating space accommodating the adsorbent is referred to as an initial residual gas amount [cc], and a barrier property of the outer covering member with respect to gas is referred to as gas barrier performance [cc/day]. At this time, each of the life [days] of the adsorption of the first gas adsorbent 49 and the life [days] of the adsorption of the second gas adsorbent 53 is represented by Formula (1) below.

$$\text{Life [days] of adsorbent} = (\text{Adsorption ability [cc/g]} \times \text{Adsorbent amount [g]} - \text{Initial residual gas amount [cc]}) / \text{Gas barrier performance [cc/day]} \quad (1)$$

Therefore, based on Formula (1), the life of the second gas adsorbent 53 can be set to be longer than the life of the first gas adsorbent 49.

Figure 7A:
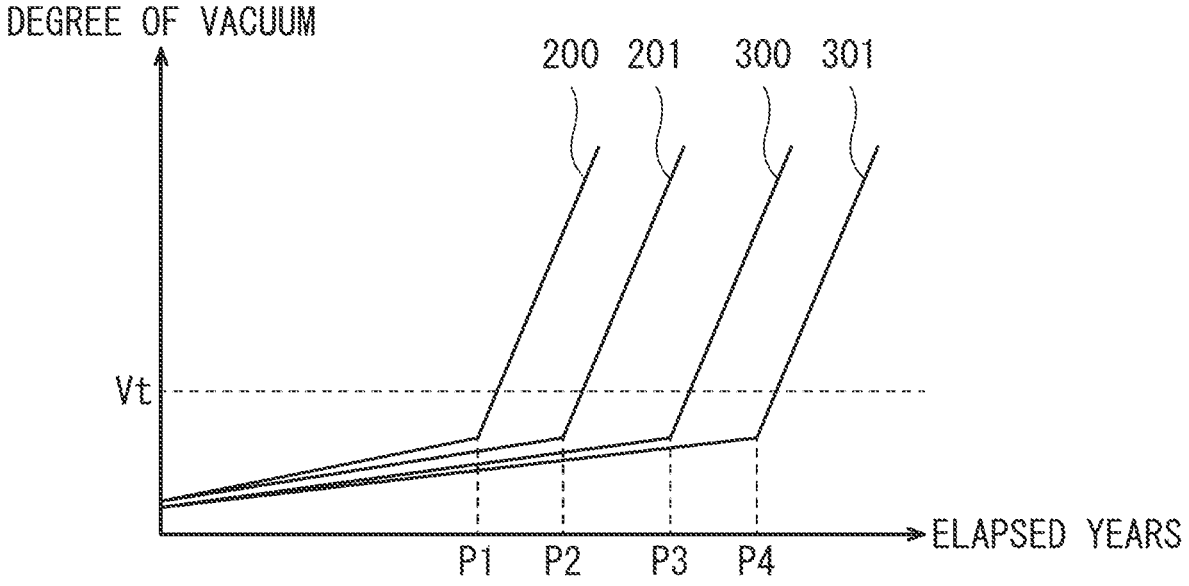
FIG. 7A is a graph showing time changes of the degree of vacuum of the heat insulating container bodies and the heat insulating lid bodies in a heat insulating space.

For example, the adsorbent can be designed based on Formula (1) such that the time change of the degree of vacuum in the heat insulating space becomes the time change shown in the graph of FIG. 7A. Herein, Vt denotes a threshold of the degree of vacuum by which the heat insulating container body 40 and the heat insulating lid body 50 can secure necessary cold insulation performance. Moreover, each of graphs 200 and 201 shows the time change of the degree of vacuum of the heat insulating container body 40 including the first gas adsorbent 49 designed based on Formula (1). In consideration of possible variations of respective parameters in Formula (1), the graph 200 shows the fastest time change, and the graph 201 shows the slowest time change. Similarly, each of graphs 300 and 301 shows the time change of the degree of vacuum of the heat insulating lid body 50 including the second gas adsorbent 53 designed based on Formula (1). In consideration of possible variations of respective parameters in Formula (1), the graph 300 shows the fastest time change, and the graph 301 shows the slowest time change.

Figure 7B:
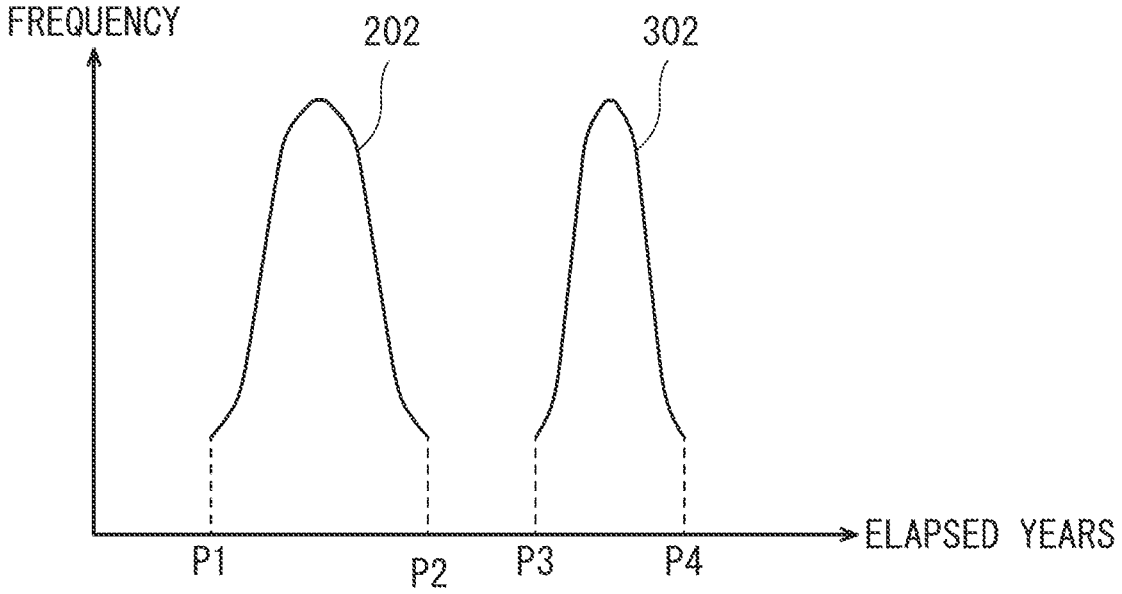
FIG. 7B is a graph showing life distributions of the heat insulating container body and the heat insulating lid body.

Moreover, FIG. 7B shows a life distribution of a plurality of samples of the heat insulating container body 40 including the first gas adsorbent 49 and a life distribution of a plurality of samples of the heat insulating lid body 50 including the second gas adsorbent 53. As shown in FIG. 7A, each of the aging degradation of the degree of vacuum of the heat insulating container body 40 and the aging degradation of the degree of vacuum of the heat insulating lid body 50 tends to slowly proceed in a period from the start till a certain time point, and after the certain time point, quickly proceed and exceed the threshold Vt. Therefore, time points P1 to P4 that are change points of the proceeding speed of the aging degradation can be defined as the life of the heat insulating container body 40 and the life of the heat insulating lid body 60.

Then, as shown in FIGS. 7A and 7B, according to the design based on Formula (1), the life of the heat insulating container body 40 in consideration of the variations can fall within a range from P1 to P2, and the life of the heat insulating lid body 50 in consideration of the variations can fall within a range from P3 to P4. As above, the heat insulating container body 40 and the heat insulating lid body 50 can be designed such that the periods of the lives of the heat insulating container body 40 and the heat insulating lid body 50 do not overlap each other even in consideration of the variations. In addition, the life of the heat insulating lid body 50 can be designed so as to be longer than the life of the heat insulating container body 40.

A heat storage unit 70 can be accommodated in the internal space 40*b* of the heat insulating container body 40 included in the vacuum heat insulating container 1. For example, the heat storage unit 70 is put in the vacuum heat insulating container 1, and articles, such as medicines or samples, are accommodated in the heat storage unit 70. With this, temperature environment formed around the articles by the heat storage unit 70 is maintained by the vacuum heat insulating container 1 for a long period of time.

Figure 5:
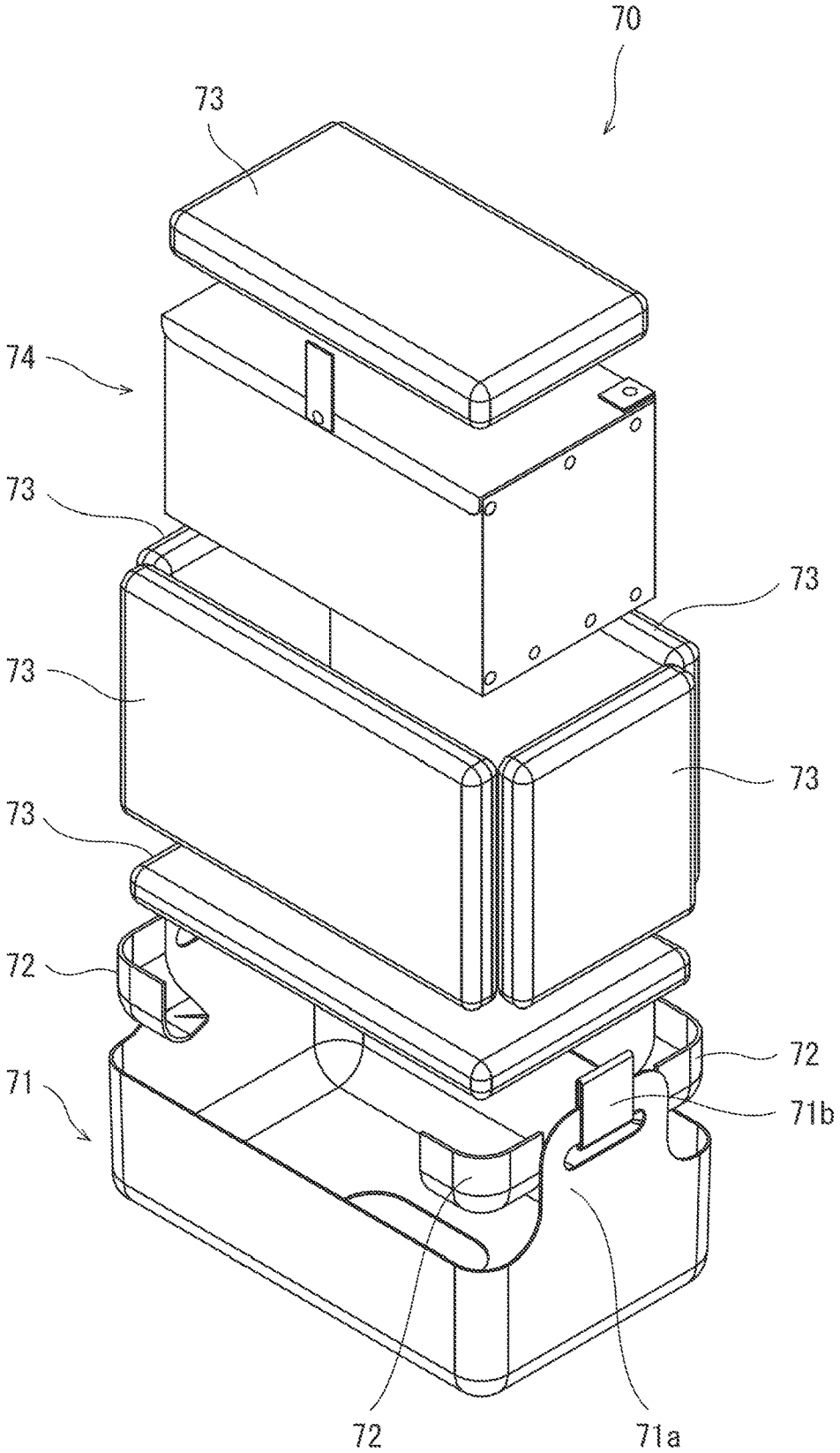
FIG. 5 is an assembly diagram showing an appearance configuration of a heat storage unit accommodated in the vacuum heat insulating container when viewed from an oblique direction.
Figure 6:
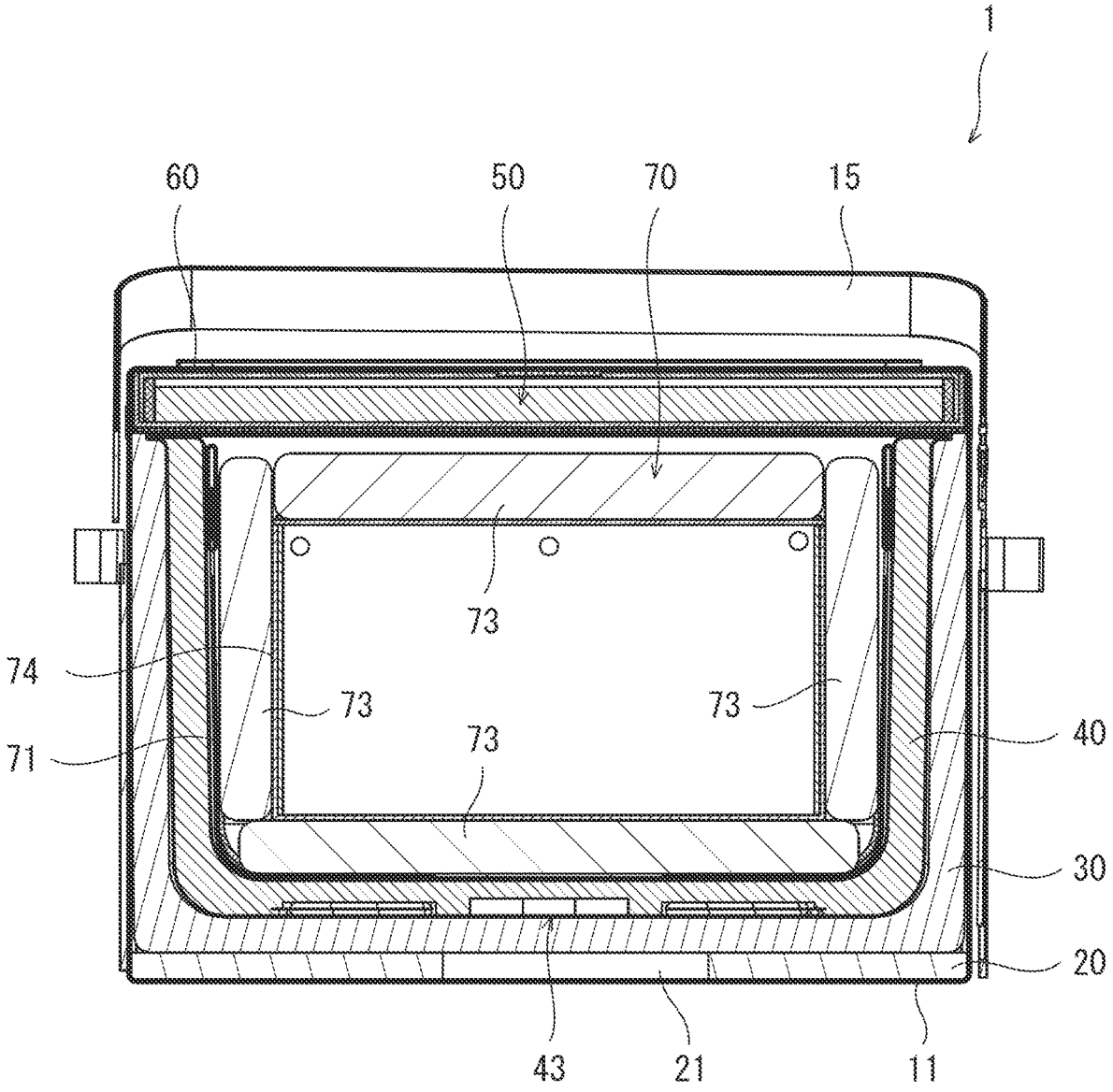
FIG. 6 is a sectional view of the vacuum heat insulating container in which the heat storage unit is accommodated.

The heat storage unit 70 will be described with reference to FIGS. 5 and 6. The heat storage unit 70 includes a basket 71, buffers 72, a plurality of heat storage mediums 73, and an inner box 74. The basket 71 has a shallow box shape including an opening at an upper portion thereof. A belt 71*b* extends between upwardly extending portions 71*a* located at left and right sides of the basket 71. In plan view, the basket 71 is substantially the same in shape and dimension as the internal space 40*b* of the heat insulating container body 40.

The buffers 72 are arranged at four corners of an inner bottom portion of the basket 71 and are attached to an inner surface of the basket 71 in advance by adhesion. Each of the heat storage mediums 73 has a flat plate shape. Six heat storage mediums 73 are prepared so as to correspond to a lower surface, four side surfaces, and an upper surface of the inner box 74. Then, the heat storage medium 73 for the lower surface is arranged on an inner bottom surface of the basket 71 to which the buffers 72 have been attached. Next, the inner box 74 having a box shape including an opening at an upper portion thereof is placed on the heat storage medium 73 for the lower surface. Then, four heat storage mediums 73 are inserted into a gap between a peripheral surface of the inner box 74 and a peripheral surface of the basket 71, and one heat storage medium 73 is placed so as to close the opening of the inner box 74.

With this, the heat storage unit 70 is accommodated in the heat insulating container body 40 with no gap. Therefore, it is possible to prevent a case where, for example, while the vacuum heat insulating container 1 is being used, the heat storage unit 70 vibrates inside the heat insulating container body 40, and this damages the inner surface of the heat insulating container body 40. As a result, the thermal insulation performance of the vacuum heat insulating container 1 can be maintained for a long period of time. Instead of the heat storage mediums 73 each having a flat plate shape, for example, pellet-shaped (granular) heat storage mediums (for example, dry ice) may be filled in the gap between the peripheral surface of the inner box 74 and the peripheral surface of the basket 71.

Moreover, in the above embodiment, the circular window 61 penetrating the upper plate 63 of the lid case 60 is described as the visible portion. However, the configuration of the visible portion is not limited to this. For example, the visible portion may be a window formed by a penetrating opening having a polygonal contour. The contour shape may be another contour shape. The position of the visible portion is not limited to the upper plate 63. Moreover, the visible portion may be configured such that a penetrating opening is covered with a light transmissive (transparent) sheet or film. Moreover, some or all of plate surfaces of the lid case 60 may be made of a light transmissive (transparent) material. Furthermore, a mark which moves in association with the deformation of the heat insulating lid body 50 in the lid case 60 may be provided as the visible portion. To be specific, the visible portion is not limited to a configuration by which the deformation of the heat insulating lid body 50 can be visually confirmed directly.

INDUSTRIAL APPLICABILITY

The vacuum heat insulating container of the present disclosure is applicable to a vacuum heat insulating container that maintains an internal temperature for a long period of time.

REFERENCE SIGNS LIST

1 vacuum heat insulating container
40 heat insulating container body
41 first outer covering member
42 first core member
49 first gas adsorbent
50 heat insulating lid body
51 second outer covering member
52 second core member
53 second gas adsorbent
60 lid case
61 window
100 container main body
101 lid body

The invention claimed is:

1. A vacuum heat insulating container comprising:

a container main body including an opening and an accommodating space communicating with the opening; and a lid body covering the opening of the container main body, wherein:

the container main body includes a heat insulating container body including a first outer covering member that is a molded body made of a nonmetal material and has a gas barrier property and a double wall structure, a first core member accommodated in an inter-wall space of the double wall structure of the first outer covering member, a pressure sensor which is accommodated in the inter-wall space of the double wall structure of the first outer covering member and is communicable with an outside, the inter-wall space of the double wall structure of the first outer covering member being reduced in pressure, and the heat insulating container body having a rectangular solid container shape as a whole;

the double wall structure of the first outer covering member is defined by an outer body having a larger volume and an inner body having a smaller volume combined with each other;

the first outer covering member includes four side portions and one bottom portion;

the double wall structure of the first outer covering member includes respective double wall structures of the side and bottom portions of the first outer covering member;

the inter-wall space of the double wall structure of the first outer covering member includes respective inter-wall spaces of the double wall structures of the side and bottom portions of the first outer covering member;

the inter-wall spaces of the double wall structures of the side and bottom portions of the first outer covering member are reduced in pressure and communicate with each other;

the lid body includes a heat insulating lid body including a second outer covering member having a sack shape formed by a flexible film which includes a metal layer and has a gas barrier property, and a second core member accommodated in the second outer covering member, an inside of the second outer covering member being reduced in pressure, a visible portion by which a surface of the second outer covering member of the heat insulating lid body is visually confirmable, and a lid case accommodating the heat insulating lid body;

the lid case includes an upper plate and a lower plate which sandwich the heat insulating lid body;

the upper plate includes a window as the visible portion and a window cover that opens and closes the window;

when the window cover is in an open state, the second outer covering member of the heat insulating lid body in the lid case is visually confirmable and touchable through the window; and the lower plate does not include the window.

2. The vacuum heat insulating container according to claim 1, comprising:

a first gas adsorbent located in the inter-wall space of the first outer covering member of the heat insulating container body; and a second gas adsorbent located in the second outer covering member of the heat insulating lid body, wherein a life of gas adsorption ability of the second gas adsorbent is longer than a life of gas adsorption ability of the first gas adsorbent.

3. The vacuum heat insulating container according to any one of claim 1, wherein:

the container main body further includes a protective member covering an outer surface of the heat insulating container body; and at a portion of the protective member which corresponds to the pressure sensor located at the heat insulating container body, a recess that is recessed from the other portion of the protective member is formed.

4. The vacuum heat insulating container according to claim 2, wherein:

the container main body further includes a protective member covering an outer surface of the heat insulating container body; and at a portion of the protective member which corresponds to the pressure sensor located at the heat insulating container body, a recess that is recessed from the other portion of the protective member is formed.

* * * * *